United States Patent [19]

Johansson

[11] 4,100,644

[45] Jul. 18, 1978

[54] VACUUM CLEANER NOZZLE WITH ROTATABLE COMB-SHAPED PART

[75] Inventor: Erik Karl Gustav Johansson, Sollentuna, Sweden

[73] Assignee: Aktiebolaget Electrolux, Stockholm, Sweden

[21] Appl. No.: 774,319

[22] Filed: Mar. 4, 1977

Related U.S. Application Data

[63] Continuation-in-part of Ser. No. 651,166, Jan. 21, 1976, abandoned.

[30] Foreign Application Priority Data

Jan. 29, 1975 [SE] Sweden ..... 7500974

[51] Int. Cl.[2] ..... A47L 9/06

[52] U.S. Cl. ..... 15/397; 15/402; 15/416

[58] Field of Search ..... 15/369, 397, 402, 416, 15/417

[56] References Cited

U.S. PATENT DOCUMENTS

| | | | |
|---|---|---|---|
| 2,276,886 | 3/1942 | Smith | 15/402 |
| 2,844,841 | 7/1958 | Bergquist | 15/417 |
| 3,745,603 | 7/1973 | Bayless et al. | 15/397 |
| 3,894,308 | 7/1975 | Carr | 15/369 |

*Primary Examiner*—Christopher K. Moore
*Attorney, Agent, or Firm*—Alfred E. Miller

[57] ABSTRACT

A nozzle for a vacuum cleaner which has an elongated comb-shaped part that can be rotated from a retracted position within the nozzle housing to another position in which it is extended out of the housing for use with a deep pile rug. The comb-shaped part has a cylindrical surface which moves adjacent to the suction channel and has an opening therein for communication between the comb-shaped part and the suction channel when said part is in its fully extended position.

4 Claims, 3 Drawing Figures

VACUUM CLEANER NOZZLE WITH ROTATABLE COMB-SHAPED PART

The present application is a continuation-in-part application of my co-pending U.S. application, Ser. No. 651,166, filed Jan. 21, 1976, now abandoned, and entitled VACUUM CLEANER NOZZLE WITH ROTATABLE COMB-SHAPED PART.

BACKGROUND OF THE INVENTION

It is known to have a vacuum cleaner nozzle in which dust-laden air can be drawn into two separate air passages. However, this arrangement requires a special valve in the nozzle thereby rendering this construction comparatively complex. For example, the valve is spring loaded and is operated by means of a pivotable part mounted in the nozzle. This valve closes one of the air passages depending on the position of the pivotable part. Consequently, the construction is not only complicated but expensive.

A construction of this type is described in U.S. Pat. No. 3,815,171.

An object of the present invention is to overcome the disadvantages of known vacuum cleaner nozzles and to provide a nozzle having separate air passages that is simple and inexpensive to manufacture.

A further object of the present invention is to provide a comb-shaped part for a vacuum cleaner nozzle that is rotatably supported in the side walls of the nozzle. The comb-shaped part is provided with an opening that extends along generally the entire length of the nozzle, while the teeth of the comb-shaped part are hollow and communicate with said opening, the latter in turn communicating with the suction channel of the vacuum cleaner. The body of the comb is further provided with a slot extending also generally along the entire length of the nozzle and which connects to a second channel which when said comb-shaped part is rotated to a second position communicates the second channel to the suction channel of the vacuum cleaner.

In order that the invention will be more clearly understood, it will now be disclosed in greater detail with reference to the accompanying drawings, in which.

DESCRIPTION OF THE PREFERRED EMBODIMENT

Figure 1:
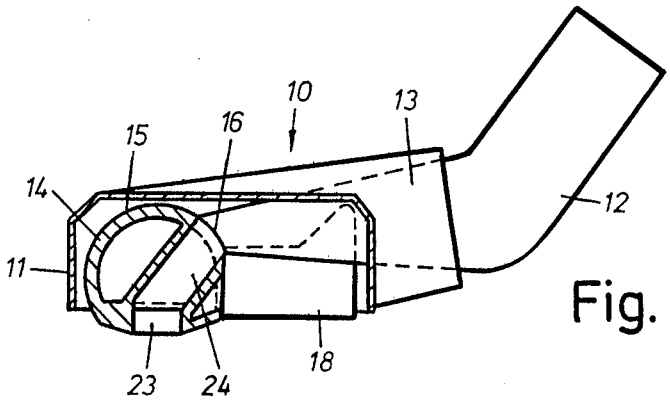
FIG. 1 is a partial sectional and a partial elevational view of the vacuum cleaner nozzle having a rotatable comb-shaped part constructed in accordance with the teachings of the present invention.
Figure 2:
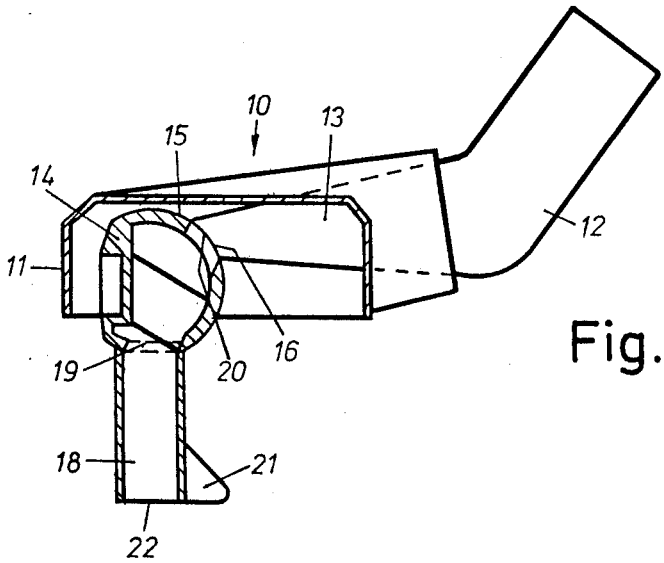
FIG. 2 is a view similar to that of FIG. 1, however with the comb-shaped part illustrated in another position.

Referring to FIGS. 1 and 2, a nozzle suitable for use with a vacuum cleaner is referred to generally by the numeral 10 and includes a housing 11 that is connected to a cylindrical tube 12, which is turnable relative to the nozzle and in use is connected, by a wand and a hose, or the like, in known manner to a fan unit producing a negative pressure in the tube 12. The tube merges into a suction channel 13 located in the nozzle, said channel opening into the front end of the nozzle. At this front end an elongate, rotatable part 14 is located and preferably has a cylindrical surface 15 at that portion which, on turning, abut the front end 16 of the suction channel 13. The part 14 is supported at both ends, for example by journals 17, and will thus turn about an axis which coincides with the center of curvature of the cylindrical surface 15.

Figure 3:
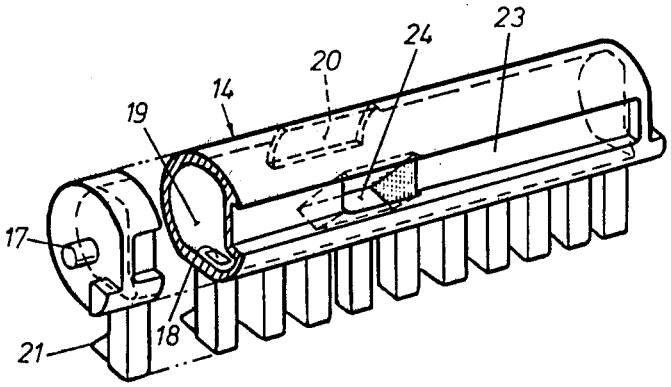
FIG. 3 is a front elevational view of the nozzle with part thereof broken away for purposes of clarity.

As seen in FIGS. 2 and 3, the part 14 has tubular teeth 18 which are arranged comb-wise and extend perpendicular to the part 14. The teeth 18 form air passages ending into a common first air channel 19 extending in the length direction of the part 14. Approximately at the middle of the channel 19 is a hole 20 in the cylindrical surface 15. The bottom portions of the teeth have triangular shaped, rearwardly projecting parts 21 designed to ensure that the openings 22 of the teeth will penetrate to the bottom of a deep pile rug to remove dust and dirt particles therefrom.

The rotatable part 14 has an additional suction opening 23, the plane of which is arranged parallel to the plane of the teeth 18. The suction opening 23 is in the form of a slot extending over approximately the entire length of the part 14. At the center of the suction opening 23 is a second air channel 24 which also opens into the cylindrical surface 15 of the rotatable part 14. The hole 20 and the opening of the air channel 24 are positioned at an angle of approximately 90° to one another.

The nozzle 10 operates in the following manner:

For cleaning a short pile rug, the suction opening 23 is used, and the teeth are retracted into the nozzle, as seen in the position shown in FIG. 1. The dust-laden air will then flow through the suction opening 23 and is then conveyed through the second channel 24 to the suction channel 13, and further through the tube 12 and the hose to a dust-collecting container (not shown). During the movement of the nozzle over the work surface, the rotatable part 14 can be held in its selected position by means of a retaining means (not shown).

In order to clean the bottom of a deep pile rug the retaining means is released. When the nozzle is moved to the right in the Figures, the teeth 18 engage with the rug and are in their lowered position. The part 14 is capable of being turned about the journals 17 until hole 20 is aligned with and exactly opposite the front end 16 of the suction channel 13. Thus, the teeth will penetrate into the rug by the aid of the plow-like parts 21 as seen in FIG. 2 so that the dust and dirt on the bottom of the rug is reached. Movement of the nozzle to the left in the Figures. causes the teeth to be retracted into the nozzle as seen in FIG. 1 which will then clean the surface of the rug. It is, of course, also possible within the scope of the present invention to lock the teeth in a lowered position by any suitable means.

It should be apparent that the present invention can be modified to make the part 14 with a comparatively large suction opening in order to mount a rotary device therein, for example a brush roller, which in one position of the rotatable part is in contact with the work surface and stirs up dust therefrom. In the other position of the part the nozzle will move over the work surface in the manner described hereinabove.

What is claimed:

1. In a vacuum cleaner nozzle having a suction channel for conducting dust-laden air to a dust container the improvement comprising a hollow housing connected to said suction channel, an elongated part having a body and a comb; said body having spaced first and second channels extending in different planes, means mounting said part in said housing for rotation therein and positioning said part adjacent to the surface to be cleaned; the teeth of said comb being hollow and open at their free ends; the opposite ends of said teeth being connected to said first channel; in a first position of said rotatable part, said comb being in an extended position, whereby an air flow path is formed through said hollow teeth, said first channel and said suction channel; and in a second position of said part said comb being retracted into a position within said hollow housing whereby an air flow path is formed through said second channel and said suction channel.

2. The combination as claimed in claim 1 wherein said teeth have triangular shaped, rearwardly extending parts at the free ends thereof for penetrating to the bottom of a deep pile rug.

3. The combination as claimed in claim 1 further comprising an elongated slot in the body of said part which extends substantially the entire length of said body and communicates with said second channel.

4. The combination as claimed in claim 1 wherein said body is provided with at least a partial cylindrical outer surface and a concave opening for said suction channel whereby said channels selectively mate with said opening upon rotation of said elongated part.

* * * * *